US011092911B2

(12) United States Patent
Yoo

(10) Patent No.: US 11,092,911 B2
(45) Date of Patent: Aug. 17, 2021

(54) TONER CONCENTRATION CONTROL USING TONER CONCENTRATION SENSOR

(71) Applicant: Hewlett-Packard Development Company, L.P., Spring, TX (US)

(72) Inventor: Jae Beom Yoo, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/769,432

(22) PCT Filed: Aug. 9, 2018

(86) PCT No.: PCT/KR2018/009079
§ 371 (c)(1),
(2) Date: Jun. 3, 2020

(87) PCT Pub. No.: WO2019/117420
PCT Pub. Date: Jun. 20, 2019

(65) Prior Publication Data

US 2020/0371450 A1 Nov. 26, 2020

(30) Foreign Application Priority Data

Dec. 14, 2017 (KR) ..... 10-2017-0172666

(51) Int. Cl.
*G03G 15/08* (2006.01)
*G03G 15/00* (2006.01)

(52) U.S. Cl.
CPC ..... *G03G 15/0851* (2013.01); *G03G 15/0877* (2013.01); *G03G 15/556* (2013.01); *G03G 15/086* (2013.01)

(58) Field of Classification Search
None
See application file for complete search history.

(56) References Cited

U.S. PATENT DOCUMENTS 4,868,601 A 9/1989 Morimoto et al.
5,164,775 A * 11/1992 Miller ..... G03G 15/0853 118/689

(Continued)

FOREIGN PATENT DOCUMENTS

EP 1 607 804 A2 12/2005
EP 2 434 350 A2 3/2012

(Continued)

*Primary Examiner* — Jas A Sanghera
(74) *Attorney, Agent, or Firm* — Jefferson IP Law, LLP

(57) ABSTRACT

An image forming apparatus includes a developing device to contain a developer, the developer including a toner; a developer cartridge to supply the developer to the developing device; a toner concentration sensor to sense a toner concentration of the toner included in the developer contained in the developing device; and a controller. The controller controls, during a non-printing operation a sensor control voltage to adjust an output level of the toner concentration sensor, to control an output of the toner concentration sensor to satisfy a controlling condition, and detects an shape of the output of the toner concentration sensor after the controller controls the sensor control voltage to adjust the output level. The controller adjusts, during a printing operation, the output of the toner concentration sensor, based on the detected shape of the output of the toner concentration sensor, and adjusts supplying the developer from the developer cartridge to the developing device, according to the adjusted output of the toner concentration sensor, to control the toner concentration.

20 Claims, 9 Drawing Sheets

(56) References Cited

U.S. PATENT DOCUMENTS

| | | | | |
|---|---|---|---|---|
| 5,270,783 | A | 12/1993 | Bisaiji et al. | |
| 7,720,402 | B2 | 5/2010 | Watanabe | |
| 8,380,092 | B2 | 2/2013 | Seki et al. | |
| 2007/0053704 | A1 | 3/2007 | Hisatomi | |
| 2007/0196116 | A1 | 8/2007 | Watanabe | |
| 2007/0223946 | A1 | 9/2007 | Watanabe | |
| 2008/0124108 | A1 | 5/2008 | Tokuyama et al. | |
| 2011/0229156 | A1 | 9/2011 | Ohkawa et al. | |
| 2013/0230332 | A1* | 9/2013 | Ishii | G03G 15/0853 399/27 |
| 2018/0259878 | A1* | 9/2018 | Tsuru | G03G 15/0856 |

FOREIGN PATENT DOCUMENTS

| | | | |
|---|---|---|---|
| JP | 2004-85710 | A | 3/2004 |
| JP | 2014-21326 | A | 2/2014 |
| JP | 2014-26175 | A | 2/2014 |
| JP | 2015-60213 | A | 3/2015 |

* cited by examiner

[Fig. 1]
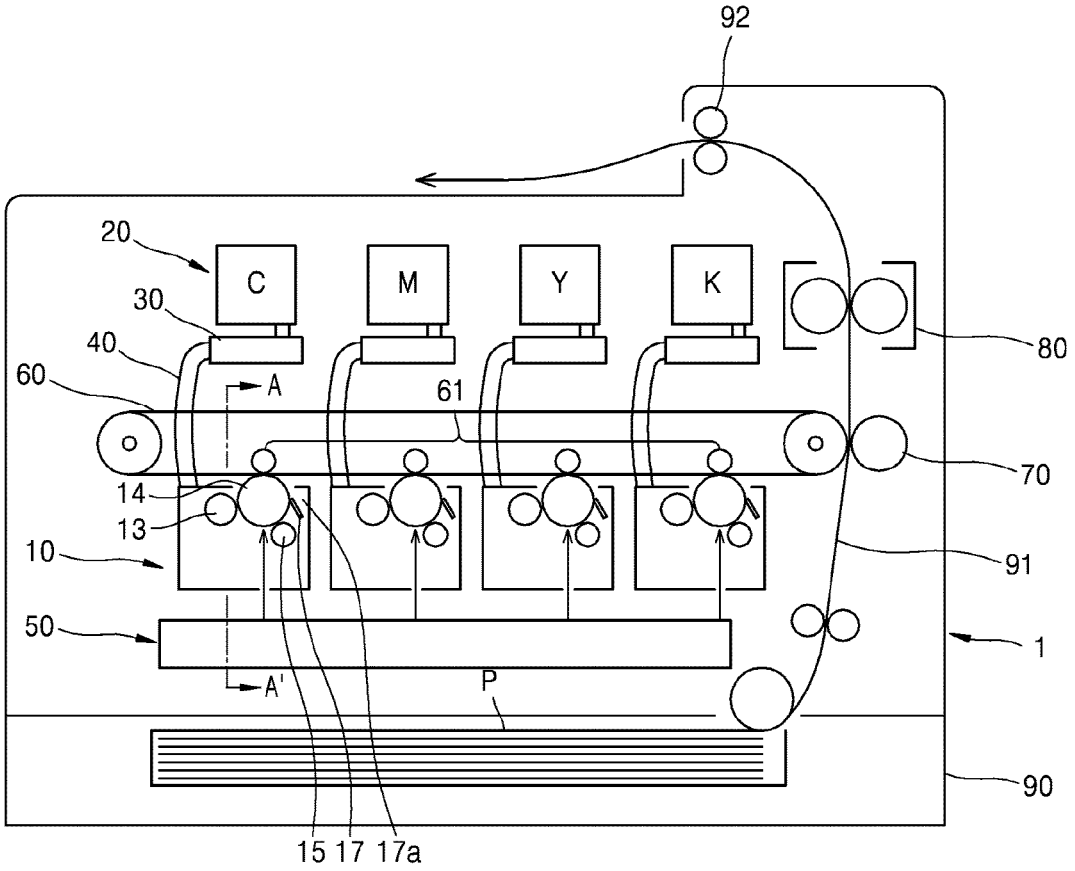

[Fig. 2A]
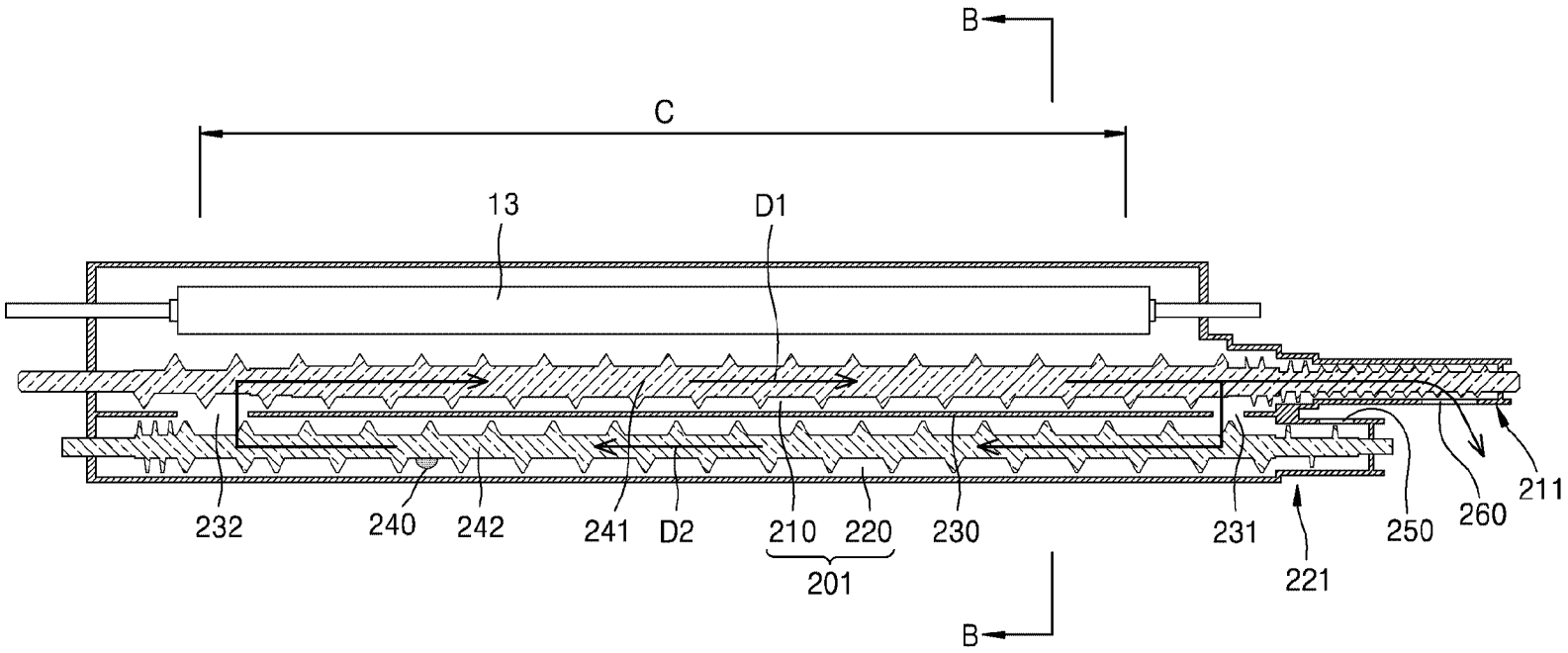

[Fig. 2B]
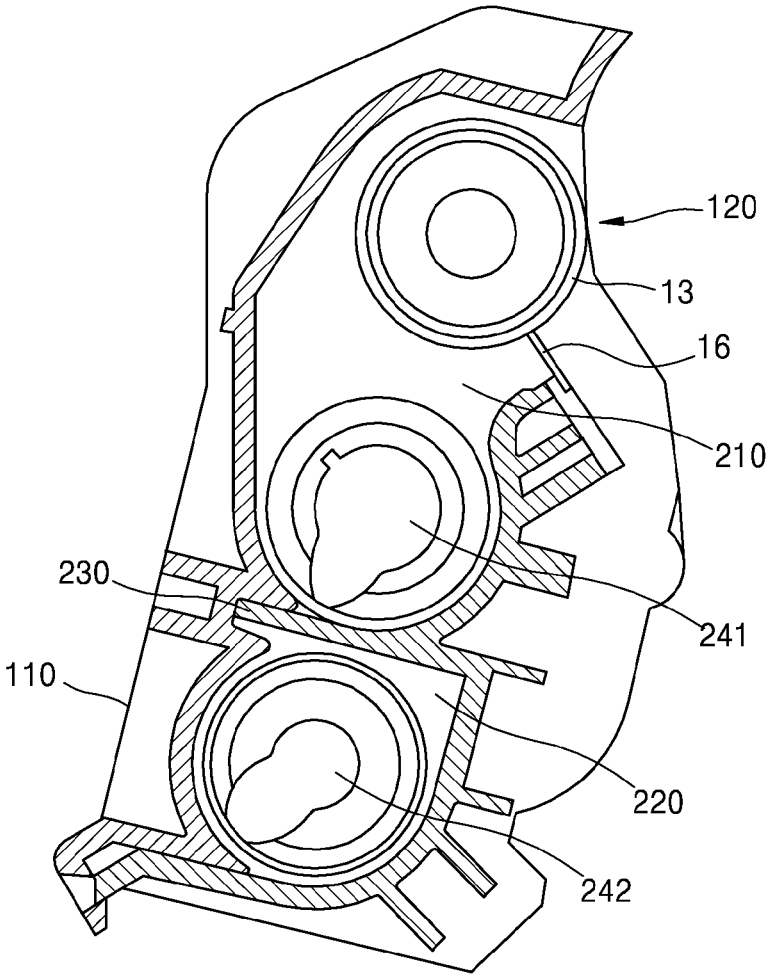
[Fig. 3]
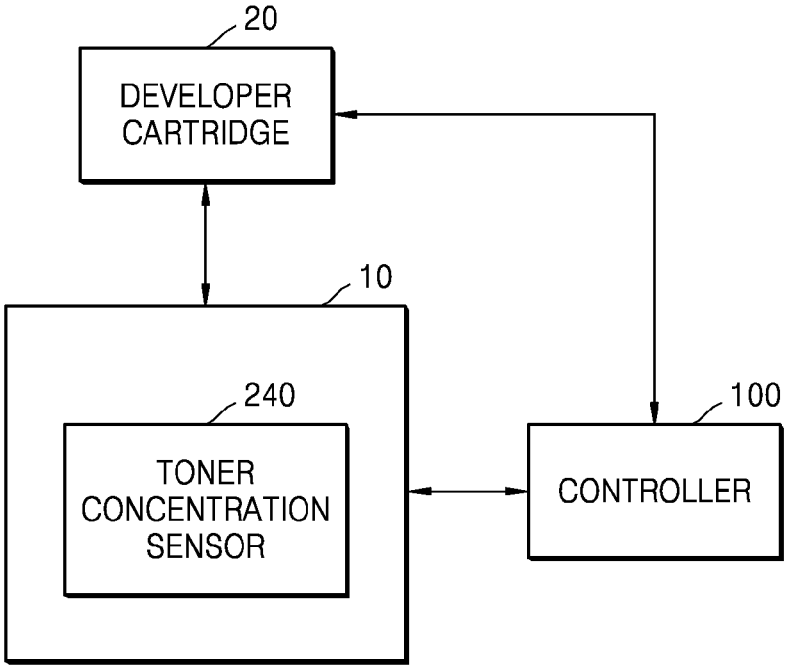

[Fig. 4]
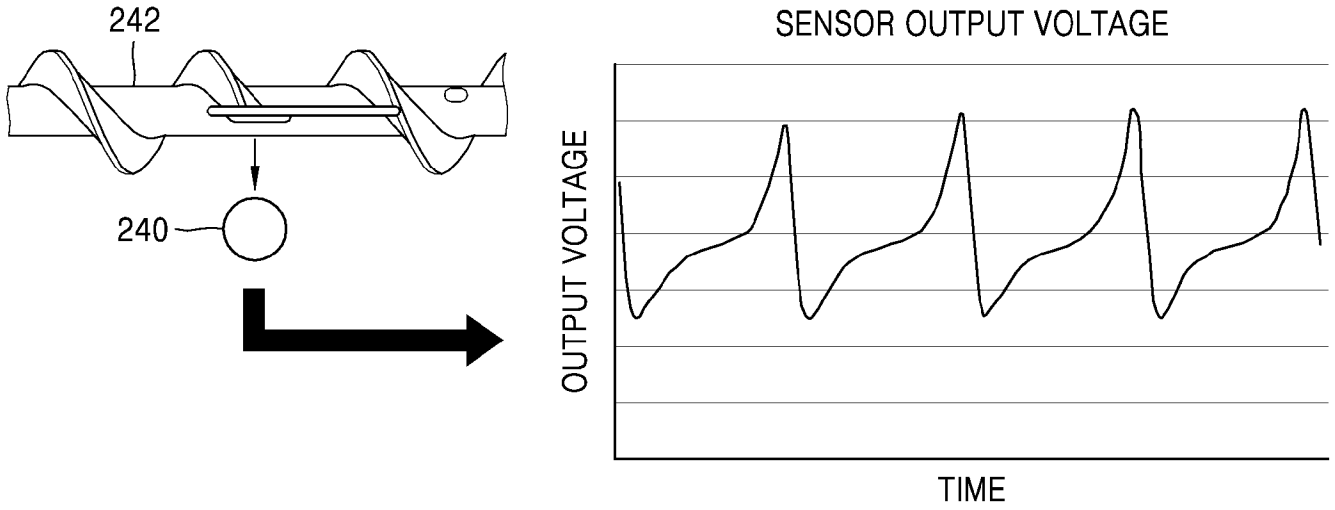

[Fig. 5]
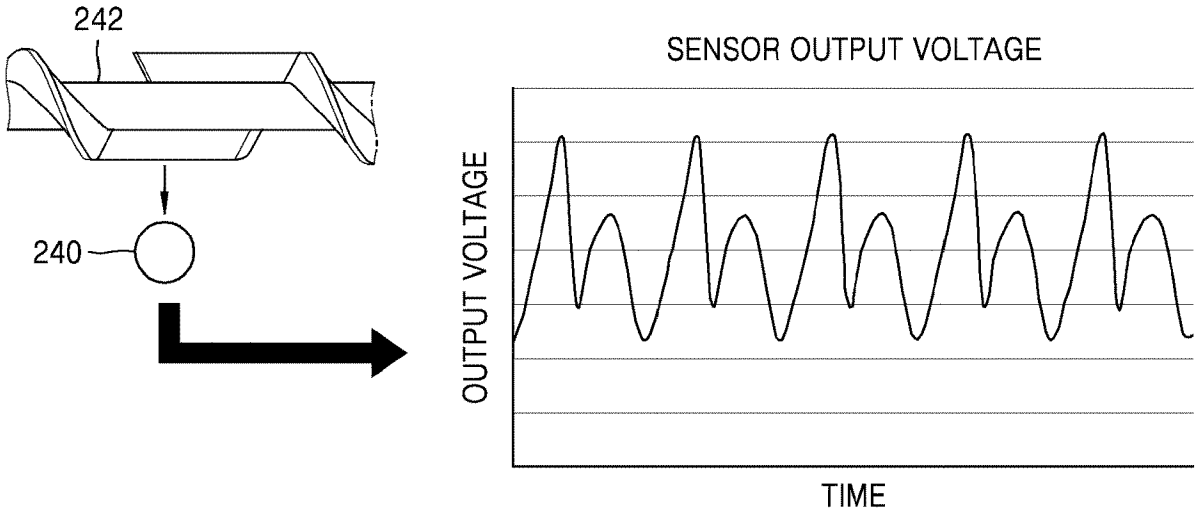
[Fig. 6]
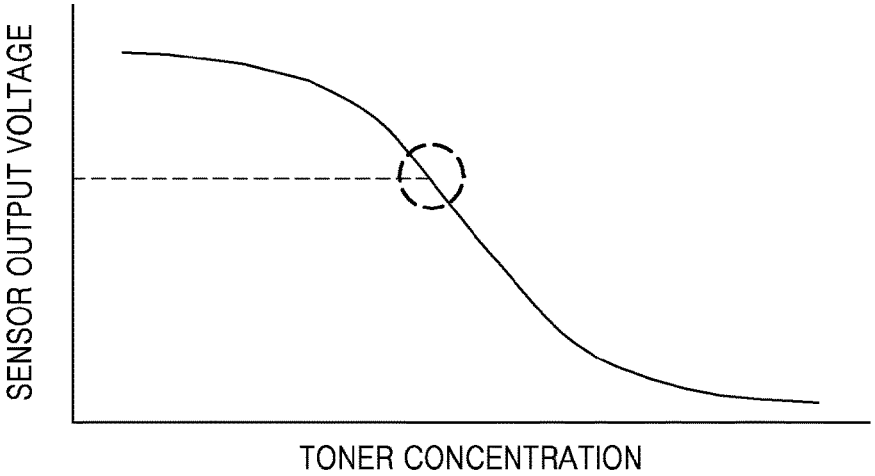

[Fig. 10]
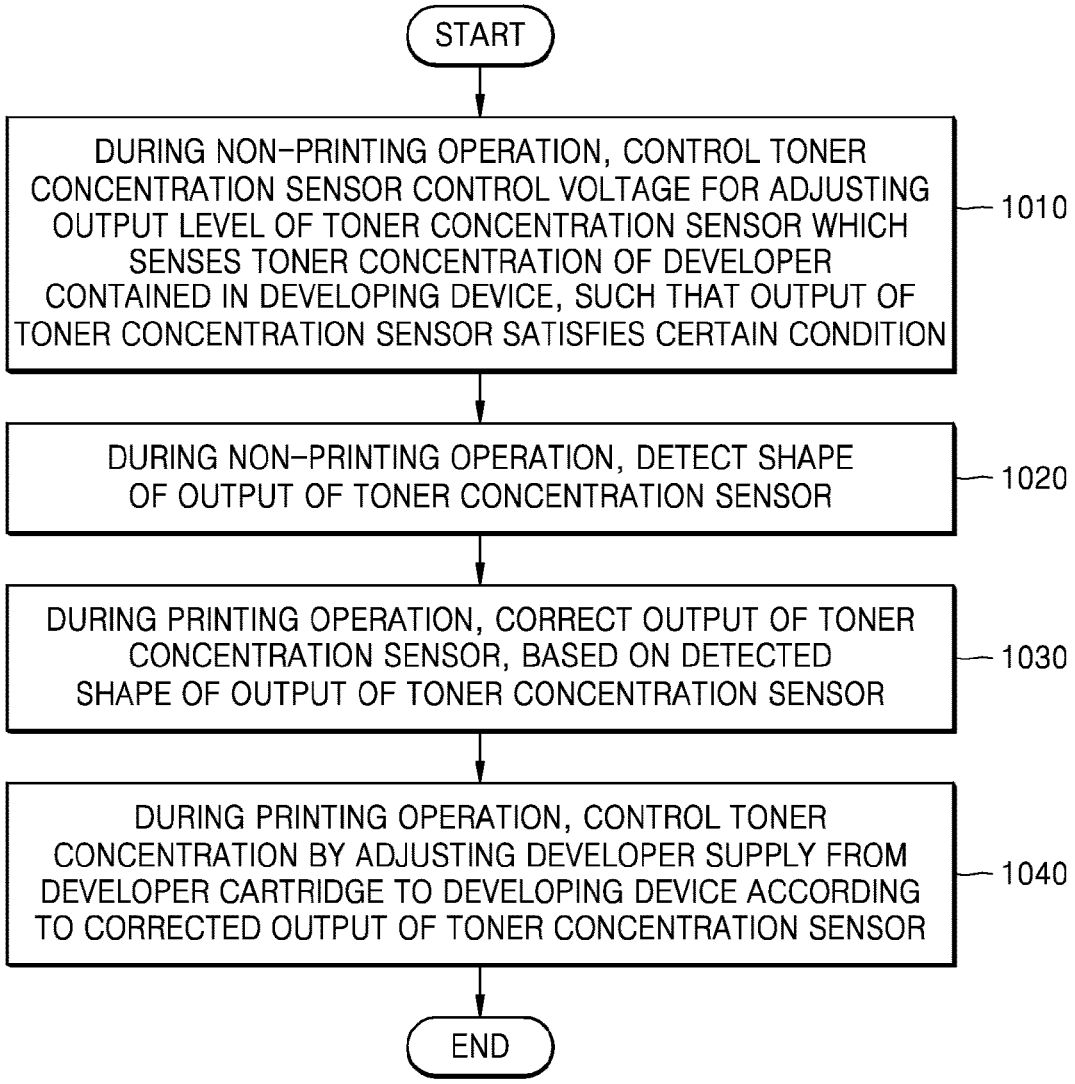

TONER CONCENTRATION CONTROL USING TONER CONCENTRATION SENSOR

BACKGROUND ART

Image forming apparatuses using an electrophotographic developing method form an image on a recording medium, such as paper, via image forming processes such as charging, exposing, developing, transferring, and fusing. In detail, when a charging roller, a developing roller, and a transfer roller are arranged at predetermined locations around a photoconductor, an image forming apparatus forms a toner image on a recording medium via charging, exposing, developing, and transferring while the photoconductor is rotating, and heats and presses the toner image to thereby fuse the toner image onto the recording medium.

An image forming apparatus using an electrophotographic developing method prints an image onto a recording medium by supplying a toner to an electrostatic latent image formed on a photoconductor to form a visible toner image on the photoconductor, transferring the toner image to the recording medium, and fusing the transferred toner image to the recording medium. A developing device supplies the toner to the electrostatic latent image formed on the photoconductor to thereby form a visible toner image on the photoconductor.

DISCLOSURE OF INVENTION

Brief Description of Drawings

FIG. 1 is a schematic diagram of an image forming apparatus using an electrophotographic developing method according to an example;

FIG. 2A is a cross-section of an example of a developing device of FIG. 1, taken along line A-A', and FIG. 2B is a cross-section taken along line B-B' of FIG. 2A;

FIG. 3 is a block diagram of a structure of an image forming apparatus that controls a toner concentration by using a toner concentration sensor, according to an example;

FIG. 4 is a diagram for explaining an output of a toner concentration sensor over time, when there is a single paddle around a shaft of an agitating member at the location of the toner concentration sensor according to an example;

FIG. 5 is a diagram for explaining an output of a toner concentration sensor over time, when there are two paddles around a shaft of an agitating member at the location of the toner concentration sensor according to another example;

FIG. 6 is a graph for explaining the output of a toner concentration sensor versus a toner concentration;

FIG. 10 is a flowchart of a method of controlling a toner concentration, according to an example.

MODE FOR THE INVENTION

Figure 7:
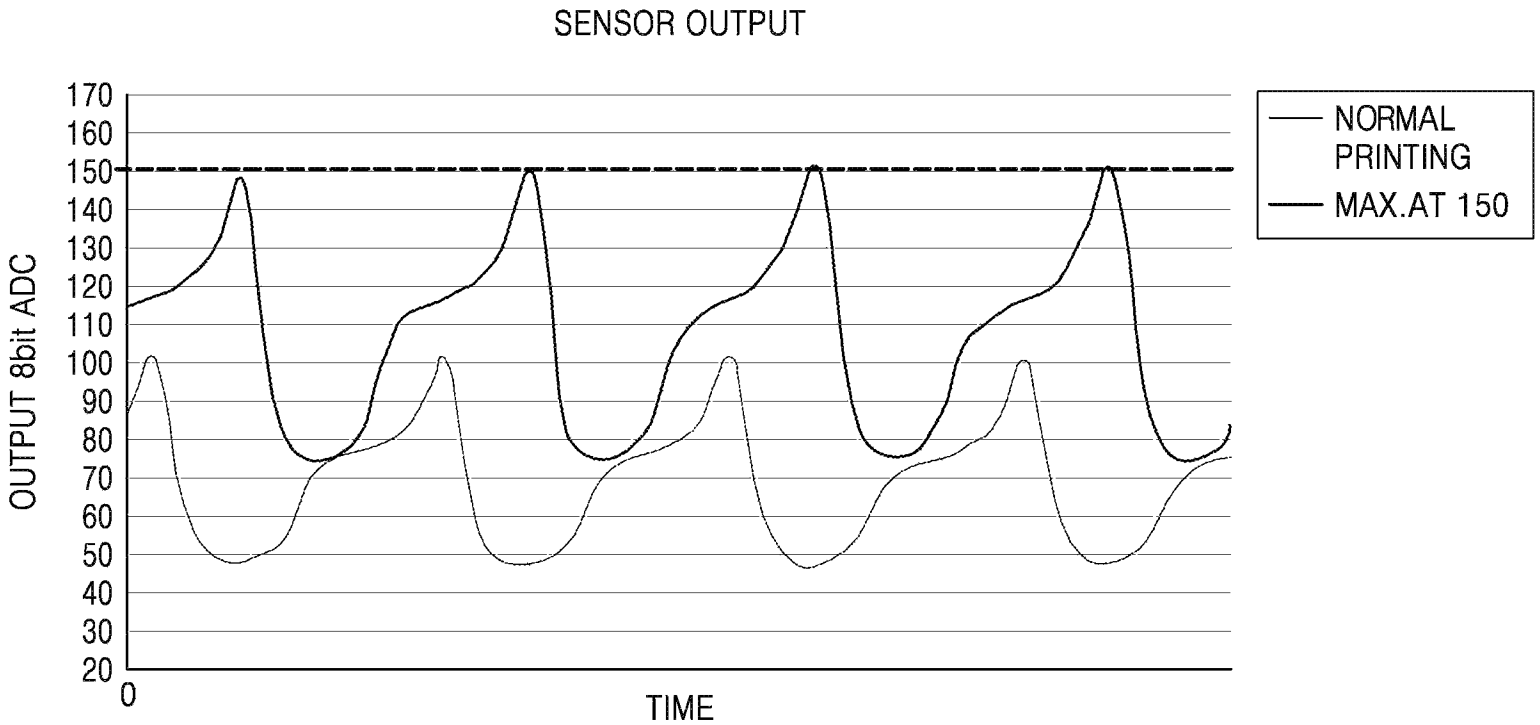
FIGS. 7 and 8 are graphs showing a result of controlling a toner concentration sensor control voltage such that a ridge of each cycle of an output of a toner concentration sensor over time becomes a certain value, when each cycle of the output of the toner concentration sensor has a single ridge.

Various examples now will be described more fully hereinafter with reference to the accompanying drawings.

Like reference numerals in the specification and drawings denote like elements, and thus their description will be omitted.

FIG. 1 is a schematic diagram of an image forming apparatus using an electrophotographic developing method according to an example. The image forming apparatus according to the present example may print a color image by using an electrophotographic developing method. Referring to FIG. 1, the image forming apparatus may include a plurality of developing devices 10, an exposure device 50, a transfer unit, and a fuser 80.

The image forming apparatus may further include a plurality of developer cartridges 20 in which developers are contained. The plurality of developer cartridges 20 may be connected to the plurality of developing devices 10, respectively, and the developers respectively contained in the plurality of developer cartridges 20 may be supplied to the plurality of developing devices 10, respectively. The plurality of developer cartridges 20 and the plurality of developing devices 10 may be detachably attached to a main body 1 and may be individually replaced.

The plurality of developing devices 10 may form toner images of a cyan (C) color, a magenta (M) color, a yellow (Y) color, and a black (K) color. The plurality of developer cartridges 20 may contain developers of a C color, an M color, a Y color, and a K color, respectively, which are to be supplied to the plurality of developing devices 10. However, examples are not limited thereto, and the image forming apparatus may further include developer cartridges 20 and developing devices 10 for containing and developing developers of other various colors such as a light magenta color, a white color, and the like. Hereinafter, the image forming apparatus including the plurality of developing devices 10 and the plurality of developer cartridges 20 will now be described, and unless there is a particular description contrary thereto, items with reference characters C, M, Y, and K indicate elements for developing developers with C color, M color, Y color, and B color, respectively.

Each developing device 10 may include a photoconductive drum 14 having an electrostatic latent image formed on its surface, and a developing roller 13 that develops the electrostatic latent image into a visible toner image by supplying a developer to the electrostatic latent image. The photoconductive drum 14, as a photoconductor having an electrostatic latent image formed on its surface, may include a conductive metal pipe and a photosensitive layer formed at an outer circumference of the conductive metal pipe. A charging roller 15 is an example of a charger that charges a surface of the photoconductive drum 14 to have a uniform surface potential. Instead of the charging roller 15, a charging brush, a corona charger, or the like may be used.

Each developing device 10 may further include a charging roller cleaner (not shown) that removes a foreign material, such as a developer or dust, attached to the charging roller 15, a cleaning member 17 that removes a developer that remains on the surface of the photoconductive drum 14 after an intermediate transfer process, and a regulating member 16 (see FIG. 2B) that regulates the amount of a developer that is supplied to a development area where the photoconductive drum 14 and the developing roller 13 contact each other. A waste developer may be contained in a waste developer containing unit 17*a*. The cleaning member 17 may be, for example, a cleaning blade that is in contact with the surface of the photoconductive drum 14 to wipe a developer off a developer.

The developer contained in each developer cartridge 20 may be supplied to the developing device 10. The developer contained in the developer cartridge 20 may be a toner. According to developing methods, a developer may be a toner and a carrier. The developing roller 13 is apart from the photoconductive drum 14. An interval between an outer circumferential surface of the developing roller 13 and that of the photoconductive drum 14 may be, for example, several tens to several hundreds of microns (μ). The developing roller 13 may be a magnetic roller. The developing roller 13 may have a shape in which a magnet is arranged within a developing sleeve that rotates. A toner and a carrier are mixed within the developing device 10, and the toner is attached to a surface of a magnetic carrier. The magnetic carrier is attached to the surface of the developing roller 13 and is conveyed to the development area where the photoconductive drum 14 and the developing roller 13 contact each other. The regulating member 16 of FIG. 2B may regulate the amount of a developer that is conveyed to the development area. Due to a developing bias voltage that is applied between the developing roller 13 and the photoconductive drum 14, the toner may be supplied to the photoconductive drum 14, and thus the electrostatic latent image formed on the surface of the photoconductive drum 14 may be developed into a visible toner image. According to developing methods, a surplus developer may be discharged to outside the developing device 10 in order to maintain the amount of a developer within the developing device 10 constant.

The exposure device 50 radiates light modulated in correspondence with image information onto the photoconductive drum 14 and forms the electrostatic latent image on the photoconductive drum 14. Examples of the exposure device 50 may include a laser scanning unit (LSU) using a laser diode as a light source and a light emitting diode (LED) exposure unit using an LED as a light source.

The transfer unit may transfer the toner image formed on the photoconductive drum 14 to a recording medium P. According to the present example, an intermediate transferring type transfer unit may be used. For example, the transfer unit may include an intermediate transfer belt 60, an intermediate transfer roller 61, and a transfer roller 70.

The intermediate transfer belt 60 may temporarily have a toner image developed on the photoconductive drum 14 of each of the plurality of developing devices 10. A plurality of intermediate transfer rollers 61 may be arranged to respectively face the photoconductive drums 14 of the plurality of developing devices 10 with the intermediate transfer belt 60 between the intermediate transfer rollers 61 and the photoconductive drums 14. An intermediate transfer bias voltage for intermediate transfer of the toner image formed on the photoconductive drum 14 to the intermediate transfer belt 60 may be applied to each of the plurality of intermediate transfer rollers 61. Instead of the intermediate transfer rollers 61, a corona transfer unit or a pin scorotron-type transfer unit may be used.

The transfer roller 70 may be positioned to face the intermediate transfer belt 60. A transfer bias voltage may be applied to the transfer roller 70 so as to transfer, to the recording medium P, the toner images transferred to the intermediate transfer belt 60.

The fuser 80 may apply heat and/or pressure to the toner images transferred onto the recording medium P to thereby fuse the toner images to the recording medium P. The shape of the fuser 80 is not limited to the example of FIG. 1.

According to the above-described structure, the exposure device 50 may form electrostatic latent images on the photoconductive drums 14 of the plurality of developing devices 10 by radiating a plurality of light beams to the photoconductive drums 14, the plurality of light beams being modulated in correspondence with pieces of image information respectively corresponding to C, M, Y, and K colors. The electrostatic latent images on the photoconductive drums 14 of the plurality of developing devices 10 may be developed into visible toner images by C, M, Y, and K developers supplied from the plurality of developer cartridges 20 to the plurality of developing devices 10. The developed toner images may be sequentially and intermediately transferred to the intermediate transfer belt 60. The recording medium P loaded on a paper supply tray 90 may be transported between the transfer roller 70 and the intermediate transfer belt 60 along a paper supply path 91. The toner images that are intermediately transferred to the intermediate transfer belt 60 may be transferred to the recording medium P due to the transfer bias voltage applied to the transfer roller 70. When the recording medium P passes through the fuser 80, the toner images are fused on the recording medium P due to heat and pressure. The recording medium P on which fusing has been completed may be discharged by a discharge roller 92.

Each developer cartridge 20 may supply a developer to each developing device 10. When a developer contained in each developer cartridge 20 is all consumed, the developer cartridge 20 may be replaced by a new developer cartridge 20, and a new developer may be charged in the developer cartridge 20.

The image forming apparatus may further include developer supply units 30. The developer supply units 30 may receive developers from the developer cartridges 20 and supply the received developers to the developing devices 10. The developer supply units 30 are connected to the developing devices 10 via supply pipelines 40, respectively. Compared to FIG. 1, the developer supply units 30 may be omitted, and the supply pipelines 40 may directly connect the developer cartridges 20 to the developing devices 10, respectively.

FIG. 2A is a cross-section of an example of the developing device 10 of FIG. 1, taken along line A-A', and FIG. 2B is a cross-section taken along line B-B' of FIG. 2A. The developing device 10 of FIGS. 2A and 2B is merely an example for explanation, and, according to developing methods, a modification of the developing device 10 of FIGS. 2A and 2B or a developing device including more or less components than those illustrated in FIGS. 2A and 2B may correspond to an example of the disclosure.

Referring to FIGS. 2A and 2B, the developing device 10 may include a development casing 110, and the developing roller 13 rotatably supported on the development casing 110. A developer is contained in the development casing 110. As described above, the developer may be supplied from the developer cartridge 20.

Within the development casing 110, a developer transporting portion 201 may be provided. The developer may be conveyed and agitated along the developer transporting portion 201.

The developer transporting portion 201 may include a developing room 210. An aperture 120 open toward the photoconductive drum 14 may be provided in the developing room 210. The developing roller 13 may be provided in the developing room 210. The developing roller 13 may be partially exposed to outside of the developing room 210 via the aperture 120, and the exposed portion of the developing roller 13 may face the photoconductive drum 14. The developing roller 13 may supply a toner contained in the developing room 210 to the electrostatic latent image formed on the photoconductive drum 14 via the aperture 120 and thus develop the electrostatic latent image into the toner image.

The developer transporting portion 201 may further include an agitating room 220. The agitating room 220 may be divided from the developing room 210 by a partition 230.

First and second agitating members 241 and 242 may be provided in the developer transporting portion 201. For example, the first agitating member 241 and the second agitating member 242 may be provided in the developing room 210 and the agitating room 220, respectively. The first agitating member 241 and the second agitating member 242 may agitate a toner and a carrier while conveying the developers respectively contained in the developing room 210 and the agitating room 220 in a lengthwise direction of the developing roller 13. The first agitating member 241 and the second agitating member 242 may be, for example, augers including spiral wings. The first agitating member 241 and the second agitating member 242 may convey the developers in opposite directions. For example, the first agitating member 241 and the second agitating member 242 may convey the developers in a first direction D1 and a second direction D2, respectively. A first aperture 231 and a second aperture 232 may be provided on both ends of the partition 230 in a lengthwise direction, respectively, and thus may connect the developing room 210 and the agitating room 220 to each other. Therefore, the developer within the developing room 210 may be conveyed in the first direction D1 by the first agitating member 241. The developer may be conveyed to the agitating room 220 via the first aperture 231 provided on an end of the partition 230 in the first direction D1. The developer within the agitating room 220 may be conveyed in the second direction D2 by the second agitating member 242. The developer may be conveyed to the developing room 210 via the second aperture 232 provided on an end of the partition 230 in the second direction D2. According this structure, the developer may circulate along a circulation path formed by the developing room 210, the first aperture 231, the agitating room 220, the second aperture 232, and the developing room 210. A portion of the developer that is conveyed in the first direction D1 within the developing room 210 may be supplied to the photoconductive drum 14 by the developing roller 13.

A toner concentration sensor 240 may be mounted on the developer transporting portion 201. The toner concentration sensor 240 may sense a toner concentration of the developer that is conveyed and agitated along the developer transporting portion 201.

The developing device 10 may include a developer inlet 250. The developer may be supplied from the developer cartridges 20 to the inside of the developing device 10, namely, to the developer transporting portion 201, via the developer inlet 250. The developer inlet 250 is located outside a valid image area C of the developing roller 13. The valid image area C denotes a portion of the length of the developing roller 13 that is validly used in image formation. A length of the valid image area C may be slightly greater than a width of a maximum-sized recording medium P that is used by the image forming apparatus. The valid image area C may be inside of the first aperture 231 and the second aperture 232. The developer inlet 250 may be located outside the first aperture 231 and the second aperture 232.

The developing device 10 may include a supply portion 221 extending from the developer transporting portion 201 in the lengthwise direction of the developing roller 13. The developer inlet 250 may be provided in the supply portion 221. For example, the supply portion 221 may extend from the agitating room 220 beyond the first aperture 231 to the outside of the valid image area C in the first direction D1. The second agitating member 242 may extend to the inside of the supply portion 221. The developer supplied to the agitating room 220 to the developer inlet 250 is conveyed in the second direction D2 by the second agitating member 242. The supply portion 221 may extend in the second direction D2 from the agitating room 220 beyond the second aperture 232.

The developing device 10 may include a developer outlet 260. A surplus developer may be discharged to the outside of the developing device 10 via the developer outlet 260. The developer outlet 260 may be located outside the valid image area C of the developing roller 13. The developer outlet 260 may be located outside of the first aperture 231 and the second aperture 232. The developing device 10 may include a discharge portion 211 extending from the developer transporting portion 201 in the lengthwise direction of the developing roller 13. The developer outlet 260 may be provided in the discharge portion 211. For example, the discharge portion 211 may extend from the agitating room 210 to the outside of the valid image area C in the first direction D1. The first agitating member 241 may extend to the inside of the discharge portion 211. The surplus developer is conveyed by the first agitating member 241 and discharged to the outside of the developing device 10 via the developer outlet 260. Compared to FIG. 2A, the developing device 10 may not include the developer outlet 260 and the discharge portion 211.

Although the discharge portion 211 and the supply portion 221 are respectively provided in the developing room 210 and the agitating room 220 in FIG. 2A, the discharge portion 211 and the supply portion 221 may be provided in the agitating room 220 and the developing room 210, respectively.

FIG. 3 is a block diagram of a structure of an image forming apparatus that controls a toner concentration by using the toner concentration sensor 240, according to an example.

Referring to FIG. 3, the image forming apparatus that controls a toner concentration by using the toner concentration sensor 240 may include a developing device 10, a developer cartridge 20, and a controller 100, and the toner concentration sensor 240 may be provided in the developing device 10. The developer cartridge 20 may supply a developer to the developing device 10.

The toner concentration sensor 240 may sense a toner concentration of a developer contained in the developing device 10. For example, the toner concentration sensor 240 may sense the toner concentration according to a method of measuring magnetic permeability of a developer. The toner concentration sensor 240 may output a voltage that increases as the amount of carrier in a space around the toner concentration sensor 240 increases. The toner concentration sensor 240 may sense the toner concentration by previously measuring a toner concentration for each voltage value corresponding to an output of the toner concentration sensor 240 and converting a voltage corresponding to the output of the toner concentration sensor 240 into the toner concentration during a printing operation.

The toner concentration sensor 240 senses the toner concentration according to a method of sensing the amount of carrier in the space around the toner concentration sensor 240 instead of directly sensing the amount of toner within the developer. Consequently, even a developer of the same toner concentration may differently affect an output level of the toner concentration sensor 240 according to amounts and densities of the developer. The amount and density of the developer at each location of the inside of the developing device 10 may differ according to mixing and transporting of the developer within the developing device 10. For example, like the developing device 10 of FIGS. 2A and 2B, to mix and transport developers, when there are the first and second agitating members 241 and 242 rotating within the developing device 10, the amount and density of the developer at each location of the inside of the developing device 10 may change according to a rotation period of the first and second agitating members 241 and 242. Even at the location of the toner concentration sensor 240 mounted in the developing device 10, the amount and density of the developer changes at intervals of the rotation period of the first and second agitating members 241 and 242 according to the shapes of the first and second agitating members 241 and 242 in the space around the toner concentration sensor 240, and thus the output of the toner concentration sensor 240 may have a shape of a waveform that vibrates at the same interval as the rotation period of the first and second agitating members 241 and 242.

FIG. 4 is a diagram for explaining an output of the toner concentration sensor 240 over time, when there is a single paddle around a shaft of each of the first and second agitating members 241 and 242 at the location of the toner concentration sensor 240 according to an example.

Referring to FIG. 4, the output of the toner concentration sensor 240 over time has a cycle according to rotation of the second agitating member 242 and has a single ridge within each cycle due to the single paddle included in the rotating second agitating member 242. The ridge may mean a point where the output of the toner concentration sensor 240 gradually increases and then gradually decreases over time and may also mean a case where a variation in the output of the toner concentration sensor 240 is "0".

FIG. 5 is a diagram for explaining an output of the toner concentration sensor 240 over time, when there are two paddles around the shaft of each of the first and second agitating members 241 and 242 at the location of the toner concentration sensor 240 according to another example.

Referring to FIG. 5, the output of the toner concentration sensor 240 over time has a cycle according to rotation of the second agitating member 242 and has two ridges within each cycle due to the two paddles included in the rotating second agitating member 242.

When the toner concentration of the developer or the amount or density of the developer in the space around the toner concentration sensor 240 changes, the output level of the toner concentration sensor 240 as well as the shape of the output of the toner concentration sensor 240 may change. Factors that represent the output level of the toner concentration sensor 240 may be a one-cycle average value, a one-cycle maximum value, a one-cycle minimum value, a one-cycle root-mean-square (RMS) value, and the like. Factors that represent the shape of the output of the toner concentration sensor 240 may be a one-cycle peak-to-peak value, a value obtained by subtracting the one-cycle average value from the one-cycle maximum value, and a value obtained by subtracting the one-cycle RMS from the one-cycle maximum value. For example, when a toner concentration sensor control voltage is fixed to a certain value and the amount of a developer of the same toner concentration increases, the output level of the toner concentration sensor 240 may increase, and a peak-to-peak value may decrease at the waveform of the output of the toner concentration sensor 240. On the other hand, when the amount of the developer of the same toner concentration decreases, the output level of the toner concentration sensor 240 may decrease, and the peak-to-peak value may increase at the waveform of the output of the toner concentration sensor 240.

Because a factor value of the output level of the toner concentration sensor 240 continuously changes near a target value of the toner concentration, when both a factor of the output level of the toner concentration sensor 240 and a factor of the shape of the output of the toner concentration sensor 240 are sensed at an applied single toner concentration sensor control voltage, the value of the factor of the shape of the output of the toner concentration sensor 240 varies according to the output level of the toner concentration sensor 240 as a result of non-linear output characteristics, and thus the value of the factor of the shape of the output of the toner concentration sensor 240 may be inaccurately detected. When the value of the factor of the shape of the output of the toner concentration sensor 240 is inaccurately detected, the developer is excessively or insufficiently supplied, and thus the toner concentration may be inaccurately controlled.

During a non-printing operation, the controller 100 may control a toner concentration sensor control voltage for adjusting the output level of the toner concentration sensor 240, such that the output of the toner concentration sensor 240 satisfies a certain condition as a controlling condition, thereby detecting the shape of the output of the toner concentration sensor 240. For example, during the non-printing operation, the controller 100 may control the toner concentration sensor control voltage such that a ridge of each cycle of the output of the toner concentration sensor 240 becomes a certain value. In another example, when each cycle of the output of the toner concentration sensor 240 has a plurality of ridges, the controller 100 may control the toner concentration sensor control voltage such that a ridge having a big shape change around the ridge greater than a shape change around another ridge according to a change in the amount or density of the developer from among the plurality of ridges has a certain value, during the non-printing operation. The certain value is a value within a section where the absolute value of a slope or an inclination is equal to or greater than a threshold in a graph showing the output of the toner concentration sensor 240 versus the toner concentration, and thus may be a value corresponding to a section where toner concentration resolution is good.

FIG. 6 is a graph for explaining the output of the toner concentration sensor 240 versus a toner concentration.

Referring to FIG. 6, the output of the toner concentration sensor 240 versus the toner concentration has non-linear characteristics compared with the toner concentration. A slope or an inclination has a large absolute value in an intermediate output section within an output section of the toner concentration sensor 240 and has a small absolute value in a low or high output section within the output section of the toner concentration sensor 240. In the graph showing the output of the toner concentration sensor 240 versus the toner concentration, in a section where the output of the toner concentration sensor 240 is low or high, the absolute value of the inclination is small, and thus a variation in the toner concentration according to a variation in the output of the toner concentration sensor 240 is small, leading to bad resolution of the toner concentration. Accordingly, to accurately control the toner concentration, as a value within a section of the graph showing the output of the toner concentration sensor 240 where the absolute value of an inclination is equal to or greater than a threshold, a value corresponding to a section providing good toner concentration resolution is set as a certain value as a set value, and thus the toner concentration sensor control voltage may be controlled such that a ridge of each cycle of the output of the toner concentration sensor 240 becomes a certain value. Referring to FIG. 6, an output voltage of the toner concentration sensor 240 corresponding to a section where the absolute value of an inclination is largest in the graph showing the output of the toner concentration sensor 240 versus the toner concentration may become a certain value.

A non-printing operation is a case where a toner supply amount is less than or equal to a certain amount, and thus may be one of an initializing operation, a waking-up operation, a calibration operation, an auto color registration (ACR) operation, and a concentration correcting operation of the image forming apparatus. In this case, the toner supply amount is small or zero, and thus the output of the toner concentration sensor 240 may maintain a stable state.

During the non-printing operation, the controller 100 accurately detects the shape of the output of the toner concentration sensor 240 according to the same criterion as that during the printing operation avoiding distortion due to the output level of the toner concentration sensor 240, and thus may be used to control the toner concentration during the printing operation. For example, during the non-printing operation, the controller 100 may control the toner concentration sensor control voltage such that a ridge of each cycle of the output of the toner concentration sensor 240 becomes a certain value, and then may sense a shape factor of the output of the toner concentration sensor 240.

Figure 8:
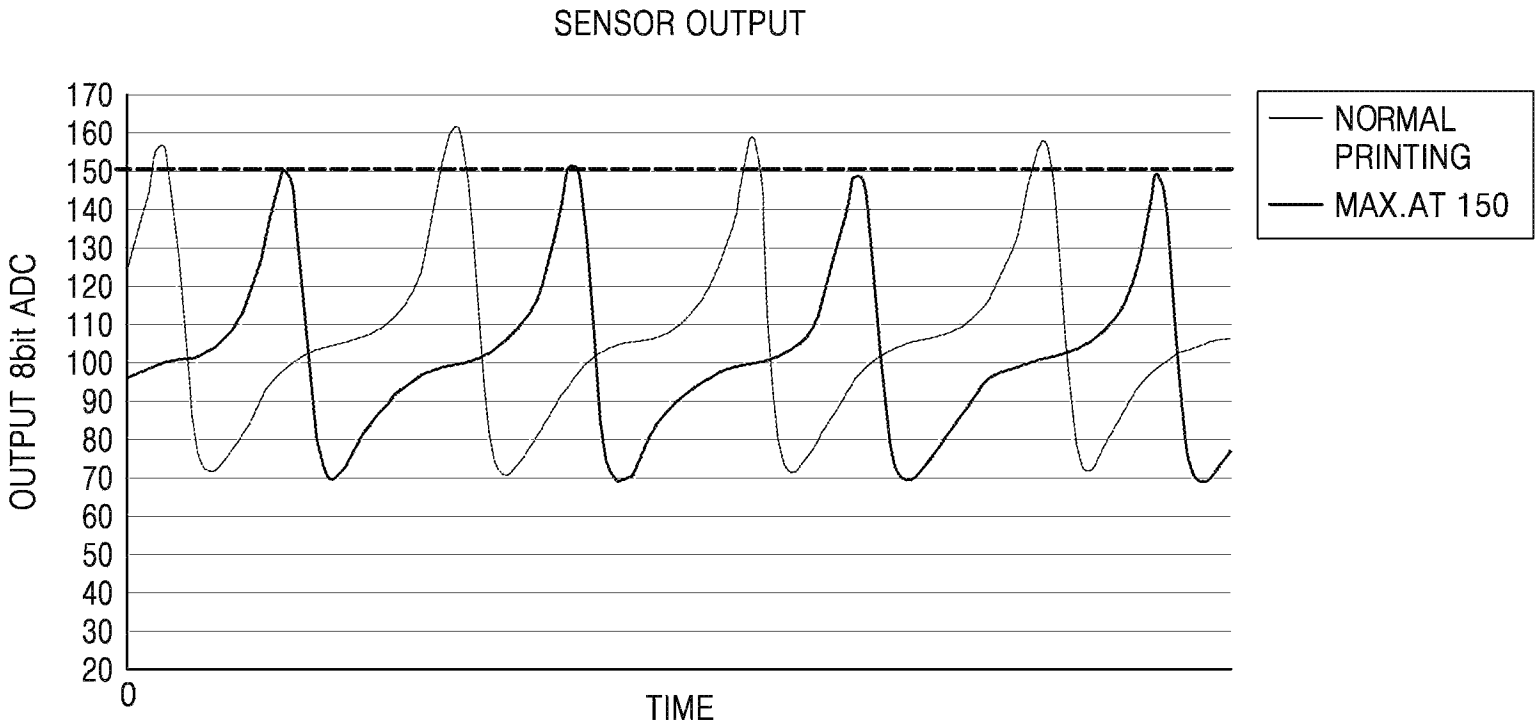

FIGS. 7 and 8 are graphs showing a result of controlling the toner concentration sensor control voltage such that a ridge of each cycle of an output of the toner concentration sensor 240 over time becomes a certain value, when each cycle of the output of the toner concentration sensor 240 has a single ridge.

FIG. 7 illustrates a case where the ridge of each cycle of the output of the toner concentration sensor 240 is less than a certain value for detecting the shape of the output of the toner concentration sensor 240. In this case, an output value at the ridge may become a certain value by increasing the output level of the toner concentration sensor 240 by increasing the toner concentration sensor control voltage.

FIG. 8 illustrates a case where the ridge of each cycle of the output of the toner concentration sensor 240 is greater than the certain value for detecting the shape of the output of the toner concentration sensor 240. In this case, an output value at the ridge may become a certain value by decreasing the output level of the toner concentration sensor 240 by decreasing the toner concentration sensor control voltage.

Figure 9:
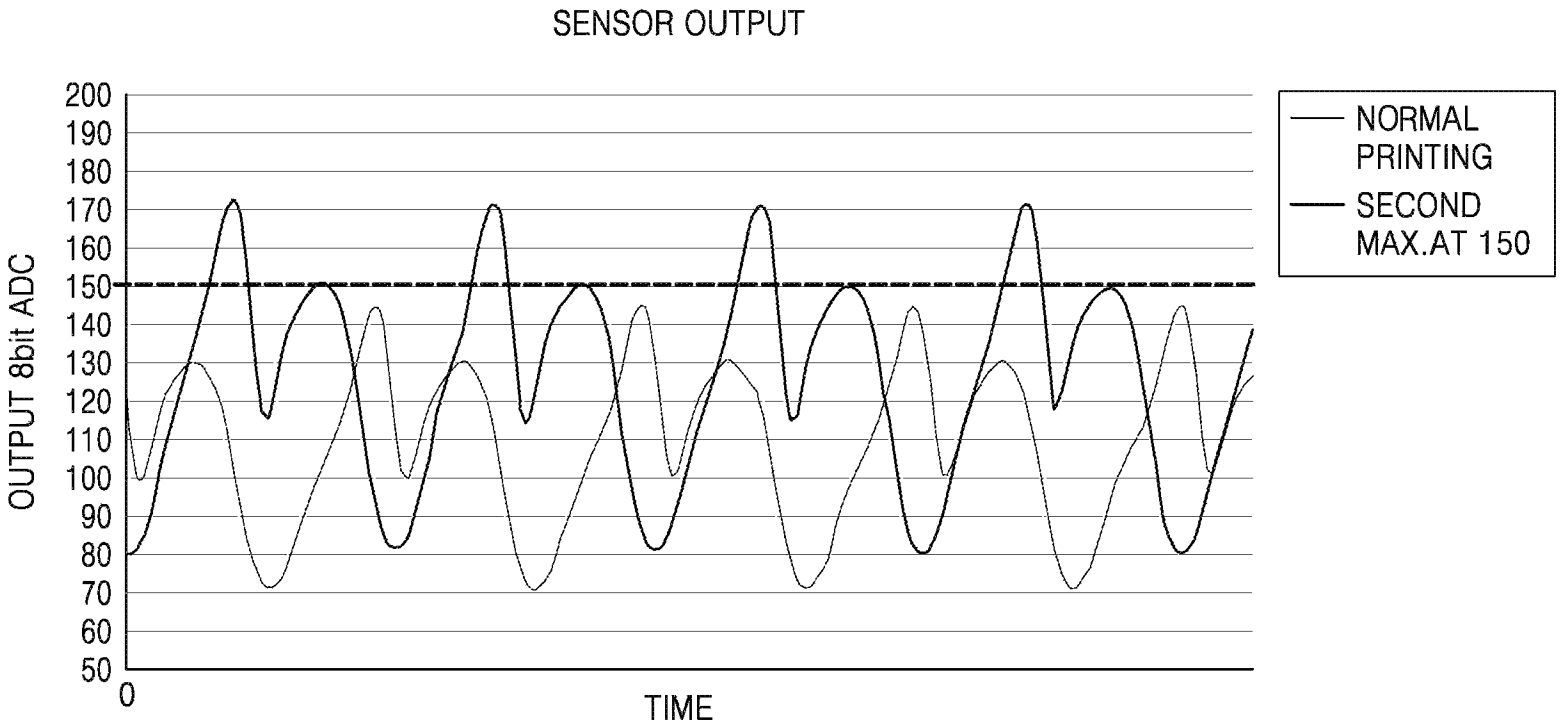
FIG. 9 is a graph showing a result of controlling a toner concentration sensor control voltage when each cycle of the output of a toner concentration sensor over time has a plurality of ridges.

FIG. 9 is a graph showing a result of controlling the toner concentration sensor control voltage when each cycle of the output of the toner concentration sensor 240 over time has a plurality of ridges.

Referring to FIG. 9, when each cycle of the output of the toner concentration sensor 240 includes a plurality of ridges, the toner concentration sensor control voltage may be controlled such that a ridge having a big shape change around the ridge according to a change in the amount or density of the developer from among the plurality of ridges has a certain value.

During a printing operation, the controller 100 may adjust or correct the output of the toner concentration sensor 240, based on a shape of the output of the toner concentration sensor 240 detected during a non-printing operation, and may adjust supply of a developer from the developer cartridges 20 to the developing device 10 according to the corrected output of the toner concentration sensor 240, thereby controlling the toner concentration. During the printing operation, the controller 100 may control the toner concentration sensor control voltage such that the output of the toner concentration sensor 240 is corrected based on the shape of the output of the toner concentration sensor 240 detected during the non-printing operation.

The controller 100 may sense a shape factor of the output of the toner concentration sensor 240 by making a ridge of each cycle of the output of the toner concentration sensor 240 become a certain value during the non-printing operation, and then may change the toner concentration sensor control voltage to a value during the printing operation. The controller 100 may sense a shape factor of the output of the toner concentration sensor 240 by making a ridge of each cycle of the output of the toner concentration sensor 240 become a certain value, then may adjust the output level of the toner concentration sensor 240 based on a change in the amount or density of the developer by adjusting the toner concentration sensor control voltage according to the value of the shape factor of the output of the toner concentration sensor 240 during the printing operation, and may make the toner concentration maintain a target value by adjusting developer supply to a developer supply amount that is determined by the corrected output level of the toner concentration sensor 240.

For example, when a peak-to-peak value of the output of the toner concentration sensor 240 detected during the non-printing operation decreases below a peak-to-peak value of the output of the toner concentration sensor 240 detected during previous output level adjustment and an output level of the toner concentration sensor 240 at the toner concentration sensor control voltage during the non-printing operation is equal to or greater than an output level of the toner concentration sensor 240 at the toner concentration sensor control voltage during the previous output level adjustment, the controller 100 may decrease the toner concentration sensor control voltage to be less than a toner concentration sensor control voltage during a previous printing operation, during the printing operation, thereby correcting the output level of the toner concentration sensor 240. The controller 100 may control the toner concentration by adjusting the developer supply to the developer supply amount determined by the corrected output level of the toner concentration sensor 240. The controller 100 may directly correct the amount of developer supply to the developing device 10 according to the value of the shape factor of the output of the toner concentration sensor 240 to thereby reduce the amount of developer supply. In this case, the toner concentration sensor control voltage may be made to be less than or equal to the toner concentration sensor control voltage during the previous printing operation.

On the other hand, when the peak-to-peak value of the output of the toner concentration sensor 240 detected during the non-printing operation increases above the peak-to-peak value of the output of the toner concentration sensor 240 detected during the previous output level adjustment and the output level of the toner concentration sensor 240 at the toner concentration sensor control voltage during the non-printing operation is less than or equal to the output level of the toner concentration sensor 240 at the toner concentration sensor control voltage during the previous output level adjustment, the controller 100 may increase the toner concentration sensor control voltage to be greater than the toner concentration sensor control voltage during the previous printing operation, during the printing operation, thereby correcting the output level of the toner concentration sensor 240. The controller 100 may control the toner concentration by adjusting the developer supply to the developer supply amount determined by the corrected output level of the toner concentration sensor 240. The controller 100 may directly correct the amount of developer supply to the developing device 10 according to the value of the shape factor of the output of the toner concentration sensor 240 to thereby increase the amount of developer supply. In this case, the toner concentration sensor control voltage may be made to be equal to or greater than the toner concentration sensor control voltage during the previous printing operation.

In another example, when an RMS value of one cycle of the output of the toner concentration sensor 240 detected during the non-printing operation increases above an RMS value of one cycle of the output of the toner concentration sensor 240 detected during the previous output level adjustment and the output level of the toner concentration sensor 240 at the toner concentration sensor control voltage during the non-printing operation is equal to or greater than the output level of the toner concentration sensor 240 at the toner concentration sensor control voltage during the previous output level adjustment, the controller 100 may decrease the toner concentration sensor control voltage to be less than the toner concentration sensor control voltage during the previous printing operation, during the printing operation, thereby correcting the output level of the toner concentration sensor 240. The controller 100 may control the toner concentration by adjusting the developer supply to the developer supply amount determined by the corrected output level of the toner concentration sensor 240. The controller 100 may directly correct the amount of developer supply to the developing device 10 according to the value of the shape factor of the output of the toner concentration sensor 240 to thereby reduce the amount of developer supply. In this case, the toner concentration sensor control voltage may be made to be less than or equal to the toner concentration sensor control voltage during the previous printing operation.

On the other hand, when the RMS value of one cycle of the output of the toner concentration sensor 240 detected during the non-printing operation decreases below the RMS value of one cycle of the output of the toner concentration sensor 240 detected during the previous output level adjustment and the output level of the toner concentration sensor 240 at the toner concentration sensor control voltage during the non-printing operation is less than or equal to the output level of the toner concentration sensor 240 at the toner concentration sensor control voltage during the previous output level adjustment, the controller 100 may increase the toner concentration sensor control voltage to be greater than the toner concentration sensor control voltage during the previous printing operation, during the printing operation, thereby correcting the output level of the toner concentration sensor 240. The controller 100 may control the toner concentration by adjusting the developer supply to the developer supply amount determined by the corrected output level of the toner concentration sensor 240. The controller 100 may directly correct the amount of developer supply to the developing device 10 according to the value of the shape factor of the output of the toner concentration sensor 240 to thereby increase the amount of developer supply. In this case, the toner concentration sensor control voltage may be made to be equal to or greater than the toner concentration sensor control voltage during the previous printing operation.

In another example, when an average value of one cycle of the output of the toner concentration sensor 240 detected during the non-printing operation increases above an average value of one cycle of the output of the toner concentration sensor 240 detected during the previous output level adjustment and the output level of the toner concentration sensor 240 at the toner concentration sensor control voltage during the non-printing operation is equal to or greater than the output level of the toner concentration sensor 240 at the toner concentration sensor control voltage during the previous output level adjustment, the controller 100 may decrease the toner concentration sensor control voltage to be less than the toner concentration sensor control voltage during the previous printing operation, during the printing operation, thereby correcting the output level of the toner concentration sensor 240. The controller 100 may control the toner concentration by adjusting the developer supply to the developer supply amount determined by the corrected output level of the toner concentration sensor 240. The controller 100 may directly correct the amount of developer supply to the developing device 10 according to the value of the shape factor of the output of the toner concentration sensor 240 to thereby reduce the amount of developer supply. In this case, the toner concentration sensor control voltage may be made to be less than or equal to the toner concentration sensor control voltage during the previous printing operation.

On the other hand, when the average value of one cycle of the output of the toner concentration sensor 240 detected during the non-printing operation decreases below the average value of one cycle of the output of the toner concentration sensor 240 detected during the previous output level adjustment and the output level of the toner concentration sensor 240 at the toner concentration sensor control voltage during the non-printing operation is less than or equal to the output level of the toner concentration sensor 240 at the toner concentration sensor control voltage during the previous output level adjustment, the controller 100 may increase the toner concentration sensor control voltage to be greater than the toner concentration sensor control voltage during the previous printing operation, during the printing operation, thereby correcting the output level of the toner concentration sensor 240. The controller 100 may control the toner concentration by adjusting the developer supply to the developer supply amount determined by the corrected output level of the toner concentration sensor 240. The controller 100 may directly correct the amount of developer supply to the developing device 10 according to the value of the shape factor of the output of the toner concentration sensor 240 to thereby increase the amount of developer supply. In this case, the toner concentration sensor control voltage may be made to be equal to or greater than the toner concentration sensor control voltage during the previous printing operation.

To provide printed matter having optimal quality even when toner of a developer is consumed according to a printing operation, the controller 100 may control the developer supply to the developing device 10 such that a toner and a carrier contained in the developing device 10 are mixed at a controlled ratio.

FIG. 10 is a flowchart of a method of controlling a toner concentration, according to an example. Although not described below, the above-described matters are applicable to the method of controlling the toner concentration.

In operation 1010, during a non-printing operation, the image forming apparatus may control a toner concentration sensor control voltage for adjusting the output level of the toner concentration sensor 240, which senses the toner concentration of the developer contained in the developing device 10, such that the output of the toner concentration sensor 240 satisfies a certain condition. For example, during the non-printing operation, the image forming apparatus may control the toner concentration sensor control voltage such that a ridge of each cycle of the output of the toner concentration sensor 240 becomes a certain value. In another example, during the non-printing operation, when each cycle of the output of the toner concentration sensor 240 has a plurality of ridges, the image forming apparatus may control the toner concentration sensor control voltage such that a ridge having a big shape change around the ridge according to a change in the amount or density of the developer from among the plurality of ridges has a certain value. The certain value is a value within a section where the absolute value of an inclination is equal to or greater than a threshold in a graph showing the output of the toner concentration sensor 240 versus the toner concentration, and thus may be a value corresponding to a section where toner concentration resolution is good. The non-printing operation is a case where a toner supply amount is less than or equal to a certain amount, and thus may be one of an initializing operation, a waking-up operation, a calibration operation, an ACR operation, and a concentration correcting operation of the image forming apparatus.

In operation 1020, during the non-printing operation, the image forming apparatus may detect the shape of the output of the toner concentration sensor 240. The image forming apparatus may make a ridge of each cycle of the output of the toner concentration sensor 240 have a certain value, and then sense various types of factor values to thereby detect the shape of the output of the toner concentration sensor 240.

In operation 1030, during a printing operation, the image forming apparatus may correct the output of the toner concentration sensor 240, based on the shape of the output of the toner concentration sensor 240 detected during the non-printing operation. During the printing operation, the image forming apparatus may correct an output level of the toner concentration sensor 240 based on a change in the amount or density of the developer by adjusting the toner concentration sensor control voltage according to the value of the shape factor of the output of the toner concentration sensor 240.

In operation 1040, during the printing operation, the image forming apparatus may control the toner concentration by adjusting developer supply from the developer cartridge 20 to the developing device 10 according to the corrected output of the toner concentration sensor 240. The image forming apparatus may make the toner concentration maintain a target value, by adjusting the developer supply to the developer supply amount determined by the corrected output level of the toner concentration sensor 240.

The above-described method of controlling the toner concentration may be embodied in form of a computer-readable recording medium storing computer-executable instructions or data. The above-described examples can be written as computer programs and can be implemented in general-use digital computers that execute the programs using a computer-readable recording medium. Examples of the computer-readable recording medium may include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, a magnetic tape, a floppy disk, a magneto-optical data storage device, an optical data storage device, a hard disk, a solid-state disk (SSD), and any device capable of storing an instruction or machine readable instructions, related data, a data file, and data structures and providing the instruction or machine readable instructions, the related data, the data file, and the data structures to a processor or a computer such that the processor or the computer execute the instruction.

While the present disclosure has been particularly shown and described with reference to examples thereof, it will be understood by those of ordinary skill in the art that various changes in form and details may be made therein without departing from the spirit and scope of the present disclosure.

The invention claimed is:

1. An image forming apparatus comprising:

a developing device to contain a developer, the developer including a toner;

a developer cartridge to supply the developer to the developing device;

a toner concentration sensor to sense a toner concentration of the toner included in the developer contained in the developing device; and a controller to, during a non-printing operation of the image forming apparatus not printing an image, control a sensor control voltage to adjust an output level of the toner concentration sensor, to control a ridge of each cycle of an output of the toner concentration sensor to satisfy a set value as a controlling condition, and detect a shape of the output of the toner concentration sensor after the controller controls the sensor control voltage to adjust the output level, and during a printing operation of the image forming apparatus printing the image, adjust the output of the toner concentration sensor, based on the detected shape of the output of the toner concentration sensor, and adjust supplying the developer from the developer cartridge to the developing device, according to the adjusted output of the toner concentration sensor, to control the toner concentration.

2. The image forming apparatus of claim 1, wherein the set value is a value within a section of a graph showing the output of the toner concentration sensor versus the toner concentration, the section where an absolute value of a slope of the graph is equal to or greater than a threshold in the graph.

3. The image forming apparatus of claim 1, wherein, during the non-printing operation, when each cycle of the output of the toner concentration sensor has a plurality of ridges, the controller is to control the sensor control voltage, to control, among the plurality of ridges, a ridge having a shape change around the ridge greater than a shape change around another ridge according to a change in an amount of the developer or a density of the developer from among the plurality of ridges, to satisfy the set value as the controlling condition.

4. The image forming apparatus of claim 1, wherein, when a peak-to-peak value of the output of the toner concentration sensor detected during the non-printing operation decreases below a peak-to-peak value of the output of the toner concentration sensor detected during previous output level adjustment of the toner concentration sensor, and when the output level of the toner concentration sensor at the sensor control voltage during the non-printing operation is equal to or greater than the output level of the toner concentration sensor at the sensor control voltage during the previous output level adjustment of the toner concentration sensor, the controller is to adjust, during the printing operation, the output level of the toner concentration sensor by decreasing the sensor control voltage to be less than the sensor control voltage during a previous printing operation, to adjust the output of the toner concentration sensor.

5. The image forming apparatus of claim 1, wherein, when a peak-to-peak value of the output of the toner concentration sensor detected during the non-printing operation increases above a peak-to-peak value of the output of the toner concentration sensor detected during previous output level adjustment of the toner concentration sensor, and when the output level of the toner concentration sensor at the sensor control voltage during the non-printing operation is less than or equal to the output level of the toner concentration sensor at the sensor control voltage during the previous output level adjustment of the toner concentration sensor, the controller is to adjust, during the printing operation, the output level of the toner concentration sensor by increasing the sensor control voltage to be greater than the sensor control voltage during a previous printing operation, to adjust the output of the toner concentration sensor.

6. The image forming apparatus of claim 1, wherein, when a root-mean-square (RMS) value of one cycle of the output of the toner concentration sensor detected during the non-printing operation increases above an RMS value of one cycle of the output of the toner concentration sensor detected during previous output level adjustment of the toner concentration sensor, and when the output level of the toner concentration sensor at the sensor control voltage during the non-printing operation is equal to or greater than the output level of the toner concentration sensor at the sensor control voltage during the previous output level adjustment, the controller is to adjust, during the printing operation, the output level of the toner concentration sensor by decreasing the sensor control voltage to be less than the sensor control voltage during a previous printing operation, to adjust the output of the toner concentration sensor.

7. The image forming apparatus of claim 1, wherein, when a root-mean-square (RMS) value of one cycle of the output of the toner concentration sensor detected during the non-printing operation decreases below an RMS value of one cycle of the output of the toner concentration sensor detected during previous output level adjustment of the toner concentration sensor, and when the output level of the toner concentration sensor at the sensor control voltage during the non-printing operation is less than or equal to the output level of the toner concentration sensor at the sensor control voltage during the previous output level adjustment of the toner concentration sensor, the controller is to adjust, during the printing operation, the output level of the output of the toner concentration sensor by increasing the sensor control voltage to be greater than the sensor control voltage during a previous printing operation, to adjust the output of the toner concentration sensor.

8. The image forming apparatus of claim 1, wherein, when an average value of one cycle of the output of the toner concentration sensor detected during the non-printing operation increases above an average value of one cycle of the output of the toner concentration sensor detected during previous output level adjustment of the toner concentration sensor, and when the output level of the toner concentration sensor at the sensor control voltage during the non-printing operation is equal to or greater than the output level of the toner concentration sensor at the sensor control voltage during the previous output level adjustment of the toner concentration sensor, the controller is to adjust, during the printing operation, the output level of the toner concentration sensor by decreasing the sensor control voltage to be less than the sensor control voltage during a previous printing operation, to adjust the output of the toner concentration sensor.

9. The image forming apparatus of claim 1, wherein, when an average value of one cycle of the output of the toner concentration sensor detected during the non-printing operation decreases below an average value of one cycle of the output of the toner concentration sensor detected during previous output level adjustment of the toner concentration sensor, and when the output level of the toner concentration sensor at the sensor control voltage during the non-printing operation is less than or equal to the output level of the toner concentration sensor at the sensor control voltage during the previous output level adjustment of the toner concentration sensor, the controller is to adjust, during the printing operation, the output level of the toner concentration sensor by increasing the sensor control voltage to be greater than the sensor control voltage during a previous printing operation, to adjust the output of the toner concentration sensor.

10. The image forming apparatus of claim 1, wherein, during the printing operation, the controller is to control the sensor control voltage, to control the output of the toner concentration sensor to be adjusted based on the detected shape of the output of the toner concentration sensor.

11. The image forming apparatus of claim 1, wherein during the non-printing operation, the image forming apparatus is not printing the image such that a toner supply amount is less than or equal to a toner supply amount corresponding to the printing operation.

12. The image forming apparatus of claim 11, wherein the non-printing operation is one of an initializing operation, a waking-up operation, a calibration operation, an auto color registration (ACR) operation, and/or a concentration adjusting operation of the image forming apparatus.

13. A method of controlling a toner concentration of a toner included in a developer contained in a developing device of an image forming apparatus, the method comprising:

during a non-printing operation of the image forming apparatus not printing an image, in controlling a toner concentration sensor to sense the toner concentration of the toner included in the developer contained in the developing device, controlling a sensor control voltage to adjust an output level of the toner concentration sensor, to control a ridge of each cycle of an output of the toner concentration sensor to satisfy a set value as a controlling condition;

during the non-printing operation, detecting a shape of the output of the toner concentration sensor, after the controlling the sensor control voltage to adjust the output level;

during a printing operation of the image forming apparatus printing the image, adjusting the output of the toner concentration sensor, based on the detected shape of the output of the toner concentration sensor; and during the printing operation, controlling the toner concentration by adjusting supplying the developer from a developer cartridge to the developing device according to the adjusted output of the toner concentration sensor.

14. A non-transitory computer-readable recording medium having recorded thereon instructions executable by a processor to cause controlling a toner concentration of a toner included in a developer contained in a developing device of an image forming apparatus, the non-transitory computer-readable recording medium comprising:

instructions executable to cause, in controlling a toner concentration sensor to sense the toner concentration of the toner included in the developer contained in the developing device, controlling a sensor control voltage to adjust an output level of the toner concentration sensor, to control a ridge of each cycle of an output of the toner concentration sensor to satisfy a set value as a controlling condition, during a non-printing operation of the image forming apparatus not printing an image;

instructions executable to cause detecting a shape of the output of the toner concentration sensor, during the non-printing operation, after the controlling the sensor control voltage to adjust the output level;

instructions executable to cause adjusting the output of the toner concentration sensor, based on the detected shape of the output of the toner concentration sensor, during a printing operation of the image forming apparatus printing the image; and instructions executable to cause controlling the toner concentration by adjusting supplying the developer from a developer cartridge to the developing device according to the adjusted output of the toner concentration sensor, during the printing operation.

15. The non-transitory computer-readable recording medium of claim 14, wherein the set value is a value within a section of a graph showing the output of the toner concentration sensor versus the toner concentration, the section where an absolute value of a slope of the graph is equal to or greater than a threshold in the graph.

16. The non-transitory computer-readable recording medium of claim 14, further comprising instructions to, during the non-printing operation, when each cycle of the output of the toner concentration sensor has a plurality of ridges, control the sensor control voltage, to control, among the plurality of ridges, a ridge having a shape change around the ridge greater than a shape change around another ridge according to a change in an amount of the developer or a density of the developer from among the plurality of ridges, to satisfy the set value as the controlling condition.

17. The non-transitory computer-readable recording medium of claim 14, further comprising instructions to, when a peak-to-peak value of the output of the toner concentration sensor detected during the non-printing operation decreases below a peak-to-peak value of the output of the toner concentration sensor detected during previous output level adjustment of the toner concentration sensor, when a root-mean-square (RMS) value of one cycle of the output of the toner concentration sensor detected during the non-printing operation increases above an RMS value of one cycle of the output of the toner concentration sensor detected during previous output level adjustment of the toner concentration sensor, or when an average value of one cycle of the output of the toner concentration sensor detected during the non-printing operation increases above an average value of one cycle of the output of the toner concentration sensor detected during previous output level adjustment of the toner concentration sensor, and when the output level of the toner concentration sensor at the sensor control voltage during the non-printing operation is equal to or greater than the output level of the toner concentration sensor at the sensor control voltage during the previous output level adjustment of the toner concentration sensor, adjust, during the printing operation, the output level of the toner concentration sensor by decreasing the sensor control voltage to be less than the sensor control voltage during a previous printing operation, to adjust the output of the toner concentration sensor.

18. The non-transitory computer-readable recording medium of claim 14, further comprising instructions to, when a peak-to-peak value of the output of the toner concentration sensor detected during the non-printing operation increases above a peak-to-peak value of the output of the toner concentration sensor detected during previous output level adjustment of the toner concentration sensor, when a root-mean-square (RMS) value of one cycle of the output of the toner concentration sensor detected during the non-printing operation decreases below an RMS value of one cycle of the output of the toner concentration sensor detected during previous output level adjustment of the toner concentration sensor, or when an average value of one cycle of the output of the toner concentration sensor detected during the non-printing operation decreases below an average value of one cycle of the output of the toner concentration sensor detected during previous output level adjustment of the toner concentration sensor, and when the output level of the toner concentration sensor at the sensor control voltage during the non-printing operation is less than or equal to the output level of the toner concentration sensor at the sensor control voltage during the previous output level adjustment of the toner concentration sensor, adjust, during the printing operation, the output level of the toner concentration sensor by increasing the sensor control voltage to be greater than the sensor control voltage during a previous printing operation, to adjust the output of the toner concentration sensor.

19. The non-transitory computer-readable recording medium of claim 14, further comprising instructions to, during the printing operation, control the sensor control voltage, to control the output of the toner concentration sensor to be adjusted based on the detected shape of the output of the toner concentration sensor.

20. The non-transitory computer-readable recording medium of claim 14, wherein the non-printing operation is one of an initializing operation, a waking-up operation, a calibration operation, an auto color registration (ACR) operation, and/or a concentration adjusting operation of the image forming apparatus.

* * * * *